US005647570A

United States Patent [19]

Berfield et al.

[11] Patent Number: 5,647,570

[45] Date of Patent: Jul. 15, 1997

[54] VACUUM CLEANER MOTOR MOUNTING APPARATUS

[75] Inventors: Robert C. Berfield, Jersey Shore; Ronald F. Meland, Muncy, both of Pa.

[73] Assignee: Shop Vac Corporation, Williamsport, Pa.

[21] Appl. No.: 599,117

[22] Filed: Feb. 9, 1996

Related U.S. Application Data

[62] Division of Ser. No. 230,895, Apr. 21, 1994, abandoned.

[51] Int. Cl.[6] ..... A47L 9/00

[52] U.S. Cl. ..... 248/638; 15/326

[58] Field of Search ..... 248/615, 638, 248/635; 15/326

[56] References Cited

U.S. PATENT DOCUMENTS

| | | | |
|---|---|---|---|
| 1,445,617 | 2/1923 | Jehu | 248/635 |
| 2,037,557 | 4/1936 | Ahnström | 15/16 |
| 2,089,601 | 8/1937 | Faber | 230/232 |
| 2,183,737 | 12/1939 | Bilde | 183/71 |
| 2,245,760 | 6/1941 | Clements | 230/117 |
| 2,349,215 | 5/1944 | Wahlborg | 248/26 |
| 2,731,194 | 1/1956 | Kent | 230/117 |
| 2,751,038 | 6/1956 | Acheson | 183/37 |
| 3,142,857 | 8/1964 | Fresard et al. | 15/327 |
| 3,799,703 | 3/1974 | Paine et al. | 417/312 |
| 4,196,775 | 4/1980 | Groh | 248/616 X |
| 4,334,337 | 6/1982 | Miller et al. | 15/326 |
| 4,435,877 | 3/1984 | Berfield | 15/326 |
| 4,512,713 | 4/1985 | Berfield | 415/119 |
| 4,547,927 | 10/1985 | Berfield | 15/327 F |
| 4,586,214 | 5/1986 | Berfield | 15/327 |
| 4,642,841 | 2/1987 | Berfield | 15/330 |

FOREIGN PATENT DOCUMENTS

| | | |
|---|---|---|
| 415875 | 7/1936 | Belgium . |
| 0289987A2 | 11/1988 | European Pat. Off. . |
| 0345699A2 | 12/1989 | European Pat. Off. . |
| 0382926A1 | 8/1990 | European Pat. Off. . |
| 0453163A1 | 10/1991 | European Pat. Off. . |
| 0528451A1 | 2/1993 | European Pat. Off. . |
| 0558101A2 | 9/1993 | European Pat. Off. . |
| 2517950 | 6/1983 | France . |
| 1127553 | 4/1962 | Germany . |
| 1239449 | 4/1967 | Germany . |
| 2525920A1 | 12/1976 | Germany . |
| 4100858A1 | 7/1992 | Germany . |
| 52-28369 | 4/1974 | Japan . |
| 56-35353 | 8/1979 | Japan . |
| 257490 | 9/1926 | United Kingdom . |
| 422404 | 2/1935 | United Kingdom . |
| 1256728 | 12/1971 | United Kingdom . |
| 2114429 | 8/1983 | United Kingdom . |
| 2117229 | 10/1983 | United Kingdom . |
| 2142526 | 1/1985 | United Kingdom . |

OTHER PUBLICATIONS

European Patent Office—Patent Abstracts of Japan, Publication No. JP4343816, Nov. 30, 1992.

European Patent Office—Patent Abstracts of Japan, Publication No. JP4319324, Nov. 10, 1992.

European Patent Office—Patent Abstracts of Japan, Publication No. JP4312429, Nov. 4, 1992.

European Patent Office—Patent Abstracts of Japan, Publication No. JP4272733, Sep. 29, 1992.

European Patent Office—Patent Abstracts of Japan, Publication No. JP4210030, Jul. 31, 1992.

(List continued on next page.)

*Primary Examiner*—Alvin C. Chin-Shue

*Attorney, Agent, or Firm*—Marshall, O'Toole, Gerstein, Murray & Borun

[57] ABSTRACT

A mounting apparatus for a motor having a drive shaft comprises a neck surrounding the drive shaft and extending from the motor, a resilient collar circumferentially surrounding the neck and sized to be received by a collar receiving means, a boss extending from the motor and a resilient isolator having an axially extending central bore for receiving the boss and sized to be received by an isolator receiving means. Vibrations of the motor are isolated so that radiated noise and vibration are reduced.

8 Claims, 3 Drawing Sheets

OTHER PUBLICATIONS

European Patent Office—Patent Abtstracts of Japan, Publication No. JP4193143, Jul. 13, 1992.

European Patent Office—Patent Abstracts of Japan, Publication No. JP4138122, May 12, 1992.

European Patent Office—Patent Abstracts of Japan, Publication No. JP4081600, Mar. 16, 1992.

European Patent Office—Patent Abstracts of Japan, Publication No. JP4033625, Feb. 5, 1992.

European Patent Office—Patent Abstracts of Japan, Publication No. JP3047224, Feb. 28, 1991.

European Patent Office—Patent Abstracts of Japan, Publication No. JP3039125, Feb. 20, 1991.

European Patent Office—Patent Abstracts of Japan, Publication No. JP3012123, Jan. 21, 1991.

European Patent Office—Patent Abstracts of Japan, Publication No. JP3009720, Jan. 17, 1991.

European Patent Office—Patent Abstracts of Japan, Publicaton No. JP1314524, Dec. 19, 1989.

VACUUM CLEANER MOTOR MOUNTING APPARATUS

This is a Divisional of U.S. application Ser. No. 230,895, filed Apr. 21, 1994, abandoned.

TECHNICAL FIELD

The present invention relates generally to motor mounting apparatuses, and more particularly, to an apparatus for mounting a motor in a vacuum cleaner such that radiated noise produced by the motor is reduced.

BACKGROUND ART

Electric motors are typically rigidly mounted in small appliances such as, for example, vacuum cleaners. This type of rigid mounting, however, can enable vibrations caused by the rotation of the motor to be transmitted to structural components of the appliance resulting in the generation of undesirable noise. In addition, such vibration can loosen screws and result in structural fatigue or separation of components in the appliance.

The use of rubber or rubber-like bushings to isolate vibrations caused by electric motors in appliances is known in the art. Each of Berfield, U.S. Pat. No. 4,586,214, Berfield et al., U.S. Pat. No. 4,642,841 and Berfield, U.S. Pat. No. 4,547,927 discloses the use of a bushing which surrounds a cylindrical boss which extends from an end bell of an electric motor. A longitudinal bore in the boss receives a screw which rigidly attaches the end bell to a mounting plate in the appliance. Because of this rigid attachment, vibrations of the motor are not isolated from the mounting plate, and thus from the appliance as a whole.

It is also known in the art to isolate vibrations emanating from an assembly which includes a motor and a fan impeller in a vacuum cleaner using a mounting means fabricated of rubber or another suitably resilient material. For example, Berfield, U.S. Pat. No. 4,512,713 discloses a vacuum cleaner having rubber-like gaskets disposed above and below a housing in which an impeller is contained.

SUMMARY OF THE INVENTION

In accordance with one aspect of the present invention, a mounting apparatus for a motor having a drive shaft comprises a neck surrounding the drive shaft and extending from the motor, a resilient collar circumferentially surrounding the neck and sized to be received by a collar receiving means, and a boss extending from the motor. A resilient isolator includes an axially extending central bore which receives the boss and is sized to be received by an isolator receiving means. The neck, the collar, the collar receiving means, the boss, the isolator, and the isolator receiving means maintain the motor in a desired position.

The mounting apparatus preferably also includes a further boss extending from the motor housing and a further isolator having an axially extending central bore which receives the further boss. The further isolator is sized to be received by a further isolator receiving means.

In accordance with a preferred embodiment of the present invention, the collar is fabricated of neoprene and, preferably, closed-cell neoprene. Also preferably, the boss extends from an end bell coupled to the motor and the isolator has an end that is shaped to match a surface contour of the end bell at a location from which the boss extends.

Also in accordance with the preferred embodiment of the present invention, the collar receiving means comprises a cylindrically-shaped raised portion of an upper wall of an impeller housing in a vacuum cleaner. It is further preferred that the isolator receiving means comprises a cup-shaped raised portion of the impeller housing upper wall.

Also preferably, the collar and the cylindrically-shaped raised portion cooperate to substantially create a seal between the end bell and the impeller housing upper wall. In addition, the impeller housing preferably contains a fan impeller rotatably driven by the motor shaft.

Still further in accordance with the preferred embodiment of the present invention, one or more flat regions disposed on an exterior vertical surface of the motor mate with one or more flat surfaces of a motor housing surrounding the motor to substantially prevent the motor from rotating with respect to housing.

Preferably, the motor is partially held in place by a force applied to the motor shaft by a vacuum created by the rotation of the impeller.

According to another aspect of the present invention, an apparatus for mounting a motor in a motor compartment bounded by a compartment wall comprises an end bell coupled to the motor and having an outwardly extending neck surrounding a drive shaft of the motor and an outwardly extending boss offset from the neck, a resilient collar circumferentially surrounding the neck of the end bell and first means coupled to the compartment wall for receiving the collar. A resilient isolator includes an axially extending central bore for receiving the boss. Second means are coupled to the wall for receiving the isolator. The neck, the boss, the collar, the isolator and the first and second receiving means maintain the motor in the desired position and reduce noise induced by vibration of the motor.

Other features and advantages are inherent in the apparatus claimed and disclosed or will become apparent to those skilled in the art from the following detailed description in conjunction with the accompanying drawings.

DESCRIPTION OF THE PREFERRED EMBODIMENTS

Figure 1:
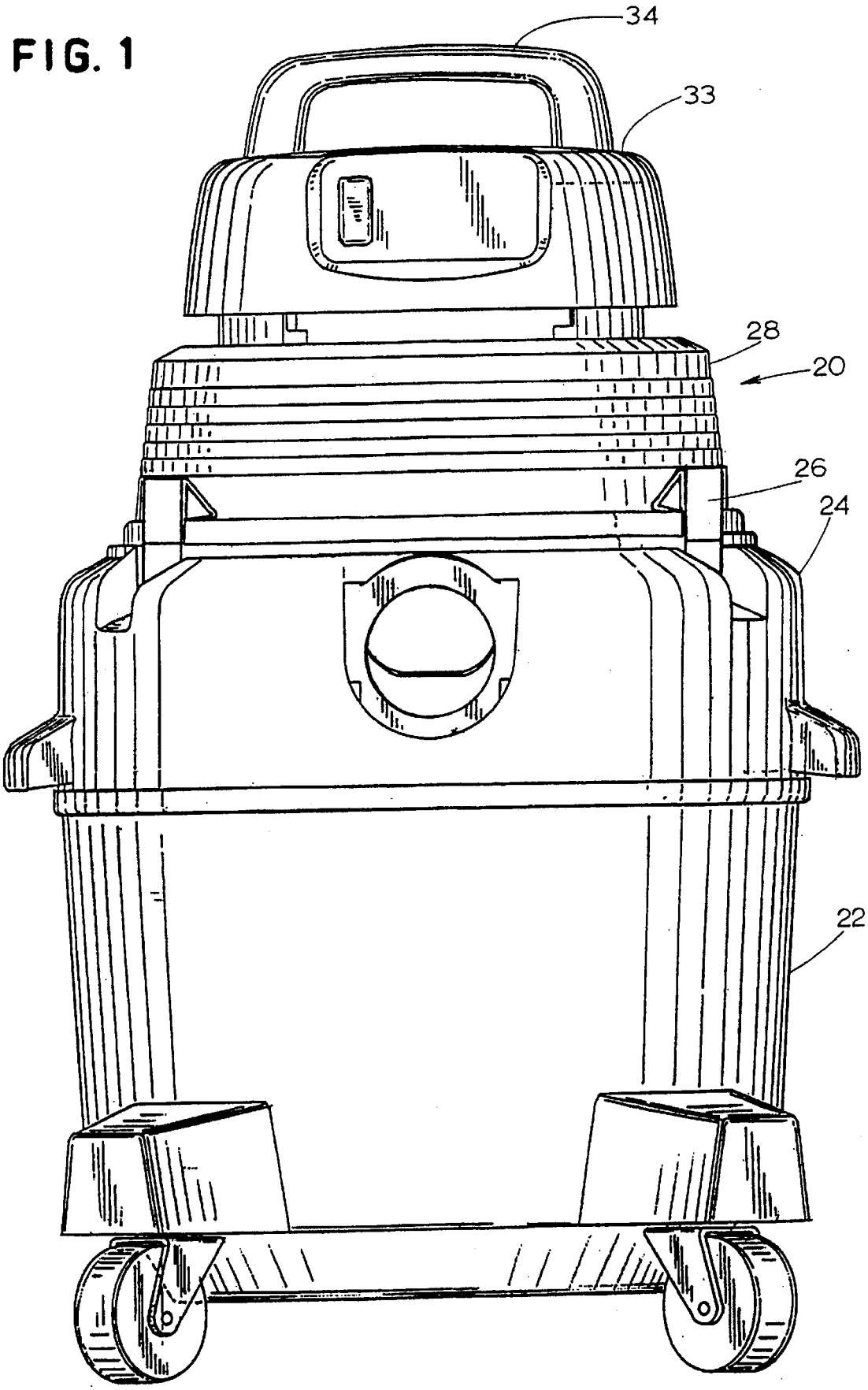
FIG. 1 comprises an elevational side view of a vacuum cleaner incorporating the motor mounting apparatus of the present invention.
Figure 2:
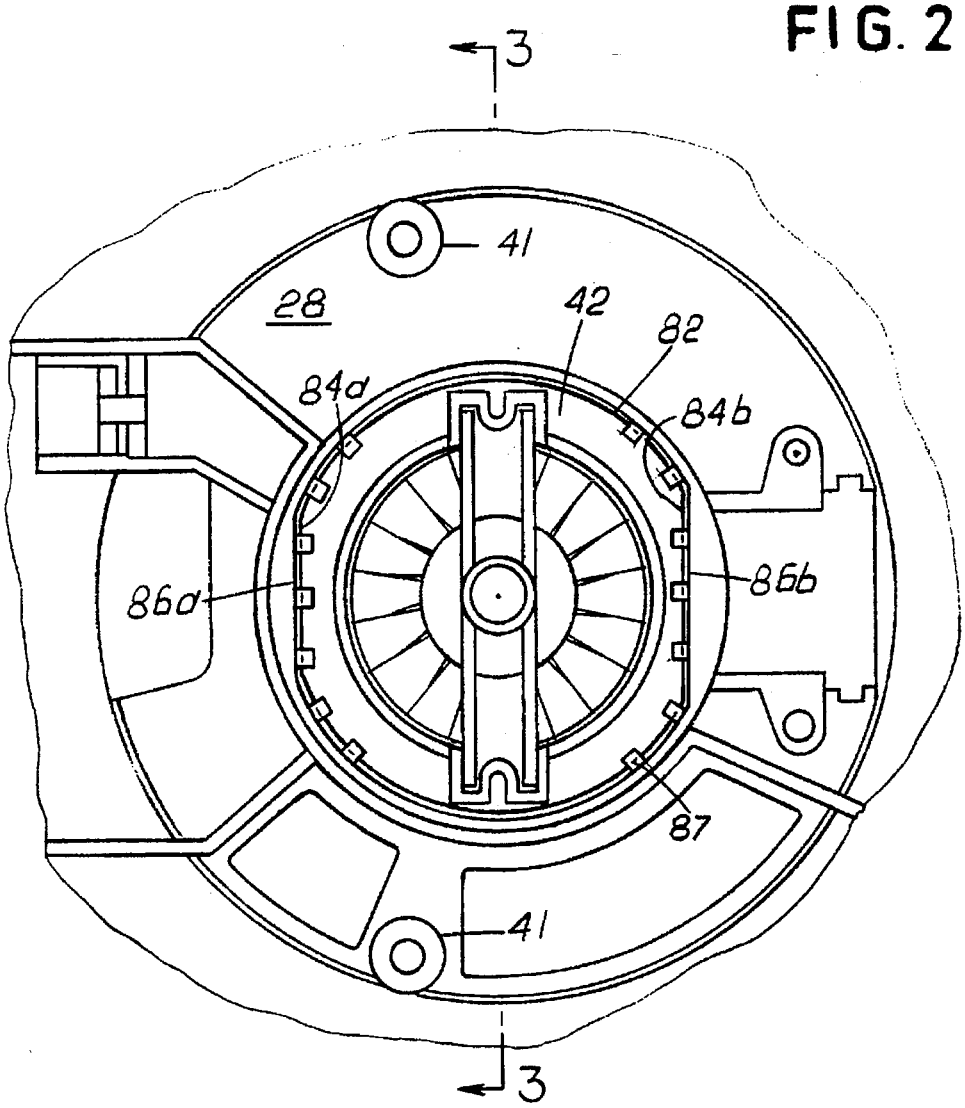
FIG. 2 comprises a fragmentary plan view of the motor housing and motor of the vacuum cleaner of FIG. 1, with the cover of the vacuum cleaner removed.
Figure 3:
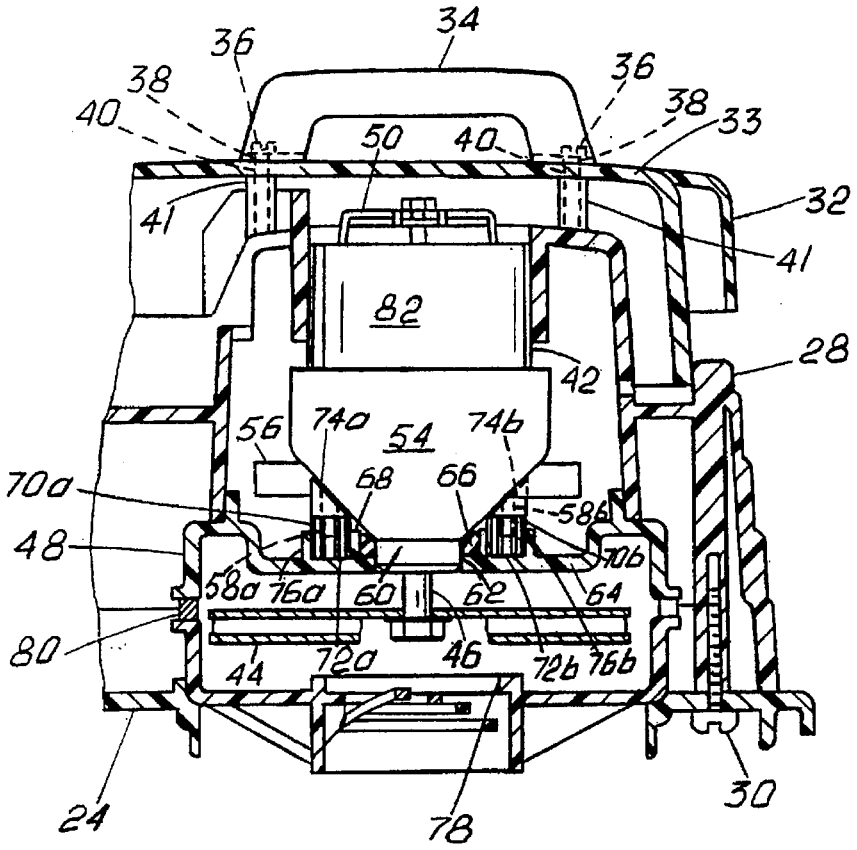
FIG. 3 comprises a partial sectional view, taken generally along the lines 3—3 of FIG. 2.

Referring first to FIGS. 1–3, a vacuum cleaner 20 includes a tank 22 and a lid assembly 24 secured thereto by a plurality of clamps 26. A molded insulated motor housing 28 is secured to the lid assembly 24 by a plurality of screws 30. A cover 32 having a top surface 33 and a handle 34 are secured to the motor housing 28 by a pair of screws 36. The screws 36 extend through a pair of clearance apertures 38 at opposite ends of the handle 34 and a pair of clearance apertures 40 in the top surface 33 of the cover 32 and are threadably received in a pair of upwardly facing bores 41 integral with the motor housing 28.

Figure 4:
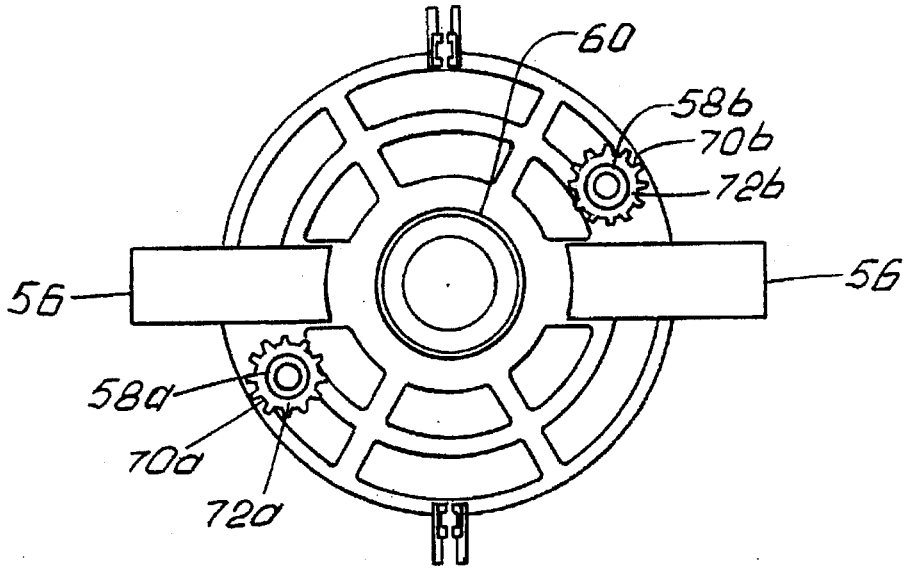
FIG. 4 comprises an elevational view, from below, of the motor end bell and isolators of FIG. 3.

Referring now to FIGS. 3 and 4, disposed within the motor housing 28 and positioned above the lid assembly 24 is an electric motor 42 having a drive shaft 46. For clarity, the motor 42 is not shown in section in FIG. 3.

Now referring to FIG. 3, a pancake-type fan impeller 44 is driven by the drive shaft 46. The impeller 44 is enclosed within an impeller housing 48. The drive shaft 46 is rotatably supported by an upper bearing (not shown) mounted within a bracket 50, and a lower bearing (not shown) rotatably mounted in a molded plastic end bell 54.

The end bell 54 includes a pair of brush holder sleeves 56 and a pair of bosses 58*a*, 58*b*. The end bell 54 also includes a central neck portion 60 which partially encloses and supports the lower bearing (not shown) and thus surrounds the drive shaft 46. The neck portion 60 protrudes downwardly through an aperture 62 in an upper wall 64 of the impeller housing 48. A resilient gasket or collar 66, preferably fabricated of closed-cell neoprene or another suitable rubber or elastomeric material, circumferentially surrounds the neck portion 60 of the end bell 54. The collar 66 is securely received in a recess defined by a cylindrically-shaped raised portion 68 extending upwardly from the upper wall 64 of the impeller housing 48.

Figure 5:
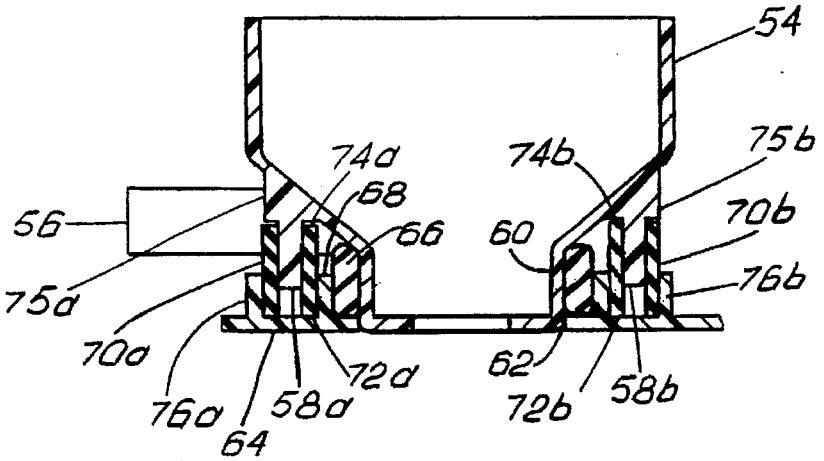
FIG. 5 comprises an enlarged partial sectional view, similar to FIG. 3, of an alternative embodiment of the present invention.

Now referring to FIGS. 3 and 4, each boss 58*a*, 58*b* is offset from the neck portion 60 and is circumferentially surrounded by a resilient cylindrical isolator 70*a*, 70*b*. Preferably, each isolator 70*a*, 70*b* has a flat lower surface 72*a*, 72*b*, respectively, which is substantially parallel to the upper wall 64, and an upper surface 74*a*, 74*b*, respectively, which is shaped to follow the surface contour of the end bell 54 at a location from which the respective boss 58*a*, 58*b* extends. Each isolator 70*a*, 70*b* preferably comprises a single piece or multiple pieces of rubber or another elastomer and, as seen in FIGS. 3 and 4, includes a plurality of longitudinal ribs. Alternatively, as seen in FIG. 5, each isolator 70*a*, 70*b* may instead have flat lower surfaces 72*a*, 72*b* and flat upper surfaces 74*a*, 74*b* and each boss 58*a*, 58*b* may have an integral or separate adapter 75*a*, 75*b* which provides a flat seating surface for the upper surface 74*a*, 74*b* of the respective isolator 70*a*, 70*b*.

The isolators 70*a*, 70*b* are sized to be received by recesses defined by cup-shaped raised portions 76*a*, 76*b*, respectively, extending upwardly from the upper wall 64. As seen in FIG. 3, a section of each raised portion 76*a*, 76*b* may intersect with a section of the raised portion 68. Preferably, each isolator 70*a*, 70*b* extends beyond each boss 58*a*, 58*b* such that neither boss 58*a*, 58*b* abuts the upper wall 64 when the motor 42 is disposed thereon. Also preferably, the end bell 54 is not rigidly attached to the upper wall 64 and the inner diameters of the raised portions 76*a*, 76*b* are only slightly larger than the outer diameters of the isolators 70*a*, 70*b*.

The collar 66 provides a seal between the impeller housing 48 and the end bell 54, thereby preventing debris and moisture which may be present in the impeller housing 48 from reaching the motor 42.

During operation, rotation of the impeller 44 by the drive shaft 46 of the motor 42 draws air into a lower aperture 78 of the impeller housing 48. The air is directed through a plurality of louvers 80 located at the outer circumference of the impeller housing 48.

As best seen in FIG. 2, disposed on an exterior vertical surface 82 of the motor 42 are a pair of opposing flat regions 84*a*, 84*b* which mate with flat surfaces 86*a*, 86*b* of the motor housing 28. The surface 82 is cylindrically shaped except for the flat regions 84*a*, 84*b*. During operation of the vacuum cleaner 20, the mating flat regions 84*a*, 84*b* of the motor 42 and the flat surfaces 86*a*, 86*b* of the motor housing 28 substantially prevent the motor 42 from rotating with respect to the motor housing 28 about the drive shaft 46. Ribs 87 (shown only in FIG. 2) are provided on the motor housing 28 to assist in maintaining the motor 42 therein particularly if the vacuum cleaner is tipped over.

Due to an area of low pressure below the impeller housing 48 created by the rotation of the impeller 44, the impeller 44 is pulled downward, along with the motor 42 attached thereto by the drive shaft 46. As a result, the end bell 54 and the motor 42 are held firmly in place, and a tight seal between the collar 66 and the impeller housing 48 is ensured. Because of the resilient nature of the isolators 70*a*, 70*b*, small movements of the end bell 54, such as those caused by vibration of the motor 42 and/or vibration of the impeller 44, are absorbed by the isolators 70*a*, 70*b*. Thus, noise caused by such vibrations is reduced.

In some applications (e.g., light duty), a single boss 58 may be sufficient. Accordingly, one of the bosses 58*a*, 58*b* and the associated isolator 70*a*, 70*b* and cup-shaped raised portion 76*a*, 76*b* may be omitted, if desired.

The foregoing description is for the purpose of teaching those skilled in the art the best mode of carrying out the invention and is to be construed as illustrative only. Numerous modifications and alternative embodiments of the invention will be apparent to those skilled in the art in view of this description. The details of the disclosed structure may be varied substantially without departing from the spirit of the invention, and the exclusive use of all modifications within the scope of the appended claims is reserved.

What is claimed is:

1. A vacuum cleaner comprising:

a motor having a drive shaft;

an impeller driven by the motor;

an impeller housing containing the impeller; and a mounting apparatus for the motor, the mounting apparatus comprising:

a neck surrounding the drive shaft and extending from the motor;

a resilient collar circumferentially surrounding the neck and sized to be received by a cylindrically-shaped raised portion of the impeller housing;

a boss extending from the motor; and a resilient isolator having an axially extending central bore for receiving the boss and sized to be received by an isolator receiving means;

wherein the resilient isolator provides a sole structural connection between the boss and the isolator receiving means.

2. The vacuum cleaner of claim 1, wherein the isolator receiving means comprises a cup-shaped raised portion of the impeller housing.

3. The vacuum cleaner of claim 2, wherein the neck is carried by an end bell and wherein the collar and the cylindrically-shaped raised portion cooperate to substantially create a seal between the end bell and the impeller housing.

4. The vacuum cleaner of claim 1, further comprising one or more flat regions disposed on an exterior vertical surface of the motor for mating with one or more flat surfaces of a motor housing surrounding the motor to substantially prevent the motor from rotating with respect to the motor housing.

5. The vacuum cleaner of claim 1, wherein the motor is partially held in place by a force applied to the drive shaft by a vacuum created by the rotation of the impeller.

6. A vacuum cleaner comprising:

a motor having a drive shaft;

an impeller driven by the motor;

an impeller housing containing the impeller; and a mounting apparatus for the motor, the mounting apparatus comprising:

a neck surrounding the drive shaft and extending from the motor;

a resilient collar circumferentially surrounding the neck and sized to be received by a cylindrically-shaped raised portion of the impeller housing;

a plurality of bosses extending from the motor; and a plurality of resilient isolators, each having an axially extending central bore for receiving a corresponding one of the bosses and sized to be received by a corresponding isolator receiving means;

wherein each resilient isolator provides a sole structural connection between the corresponding boss and the corresponding isolator receiving means.

7. A vacuum cleaner comprising:

a motor having a drive shaft and an end bell;

an impeller driven by the motor;

an impeller housing containing the impeller; and a mounting apparatus for the motor, the mounting apparatus comprising:

a neck surrounding the drive shaft and extending from the end bell;

a resilient collar circumferentially surrounding the neck and sized to be received by a cylindrically-shaped raised portion of the impeller housing;

a plurality of bosses extending from the end bell; and a plurality of resilient isolators, each having an axially extending central bore for receiving a corresponding one of the bosses and sized to be received by a corresponding isolator receiving means;

wherein each resilient isolator provides a sole structural connection between the corresponding boss and the corresponding isolator receiving means.

8. The vacuum cleaner of claim 7, wherein each resilient isolator includes an end that is shaped to match a surface contour of the end bell at a location from which the corresponding boss extends.

* * * * *